US005725462A

United States Patent [19]

Jones

[11] Patent Number: 5,725,462

[45] Date of Patent: Mar. 10, 1998

[54] RECIPROCAL INHIBITION EXERCISE DEVICE

[76] Inventor: Tom Jones, 4531 Scenario Dr., Huntington Beach, Calif. 92649

[21] Appl. No.: 523,780

[22] Filed: Sep. 5, 1995

[51] Int. Cl.[6] ..... A63B 21/02

[52] U.S. Cl. ..... 482/129; 482/907; 482/132; 482/91

[58] Field of Search ..... 482/121, 122, 482/123, 129, 130, 907, 91, 79, 132, 71, 51

[56] References Cited

U.S. PATENT DOCUMENTS

| | | | |
|---|---|---|---|
| 3,584,871 | 6/1971 | Kelmon . | |
| 3,749,400 | 7/1973 | Stoffel | 482/130 |
| 4,132,404 | 1/1979 | Wilson . | |
| 4,340,214 | 7/1982 | Schutzer . | |
| 4,522,392 | 6/1985 | Torii . | |
| 4,619,454 | 10/1986 | Walston . | |
| 4,736,944 | 4/1988 | Johnson et al. . | |
| 4,781,372 | 11/1988 | McCormack . | |
| 4,781,373 | 11/1988 | Irwin . | |
| 4,795,150 | 1/1989 | Harlan . | |
| 4,877,239 | 10/1989 | Dela Rosa . | |
| 5,209,711 | 5/1993 | Scrima | 482/51 |
| 5,295,935 | 3/1994 | Wang | 482/907 |
| 5,328,427 | 7/1994 | Sleamaker | 482/71 |

FOREIGN PATENT DOCUMENTS

| | | | |
|---|---|---|---|
| 2569569 | 3/1986 | France | 482/907 |
| 8800677 | of 1989 | Netherlands . | |
| 2120110 | of 1983 | United Kingdom . | |

*Primary Examiner*—Lynne A. Reichard
*Attorney, Agent, or Firm*—Dennis W. Beech

[57] ABSTRACT

The reciprocal inhibition exercise device has a leg beam attached perpendicular to a bottom cross member. The bottom cross member is part of a frame structure which has the bottom cross member attached to a back support member and a front support member. This part of the frame rests on the floor where the user wishes to use the exercise device. Additionally, the front support member has a front vertical support member attached and an exercise grip bar is attached between the front vertical support member and the back support member. The leg beam has a pair of foot pad slides which are attached to a spring or elastic strap which are then attached a leg beam middle plate. The foot pad slides have rotatable stirrups attached to a foot pad pedestal. The exercise device may also have a front grip bar and a back grip bar attached.

8 Claims, 5 Drawing Sheets

RECIPROCAL INHIBITION EXERCISE DEVICE

BACKGROUND OF THE INVENTION

1. Field of the Invention

This invention relates to apparatus used to exercise the limbs and torso of the lower and upper body. The new apparatus provides a means for an exercise user to stretch and exercise the legs against a force while twisting the torso about the waist and hips and stretching the upper body and arms.

2. Description of Related Art

There are currently in use various apparatus for exercising the human body. Examples of leg stretching devices include those in U.S. Pat. Nos. 4,781,372 and 4,340,214. Such devices tend to concentrate on exercise of the legs for purposes of conditioning the skier, ice skater and other specific sport related activity users.

Other apparatus with more general exercise objectives include stretching apparatus such as in U.S. Pat. No. 4,795,150 which is a complicated device for stretching the lower body muscles which includes cycling capabilities. The more traditional apparatus used for exercise include the stationary bicycle which may have movable handle bars to exercise the arms and upper body in a one dimensional direction. This is also the type of exercise the user experiences with the traditional rowing machine as for example in U.S. Pat. No. 4,736,944.

The present invention provides a simple means to stretch the legs, arms and torso while also providing torsion motion about the ankles, legs, hips, torso, shoulders and arms. The combination of the leg stretching and arm reaching and rotation created by the instant invention causes torsion about the users body elements creating a reciprocal inhibition exercise experience.

SUMMARY OF THE INVENTION

A primary objective of the present invention is to provide a means for an exercise user to exercise, stretch, strengthen and enhance range of motion of the lower torso and legs in a reciprocal inhibition manner while also providing increased range of motion in the waist, shoulder and upper torso area. Another objective is to provide lower body flexibility and strength building.

In accordance with the description presented herein, other objectives of this invention will become apparent when the description and drawings are reviewed.

DESCRIPTION OF THE PREFERRED EMBODIMENT

Figure 1:
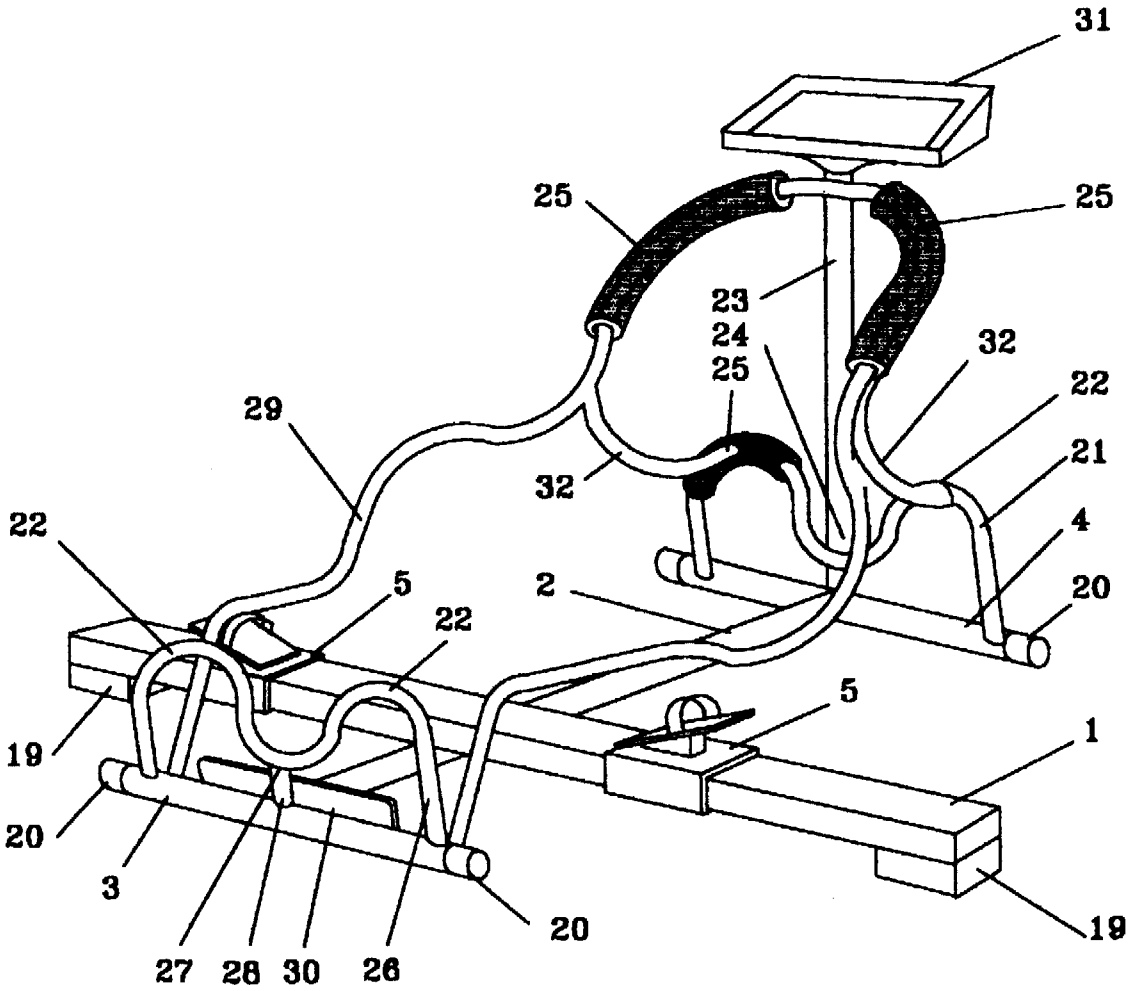
FIG. 1 illustrates a back perspective view of the exercise device.

The reciprocal inhibition exercise device consists of a lower body exercise element having a leg beam attached to a frame with a foot pad slide and elastic force element attached. The frame has a plurality of irregular shaped grip bars for comprehensive body exercise. There is also a fixed foot plate for straight leg and back flexure exercise.

Referring to FIGS. 1 through 5, a leg beam (1) is attached perpendicular to a bottom cross member (2) which bottom cross member (2) is attached perpendicular to a back support member (3) and a front support member (4). The leg beam (1) has a pair of foot pad slides (5) slidably mounted thereon. The foot pad slide (5) has an elastic support connector (6) located to move in a leg beam right slot (7) and a leg beam left slot (8) when the foot pad slide (5) moves longitudinally along the leg beam (1). The elastic support connector (6) has an elastic force element (9) connected at an end and the elastic force element (9) also connected at the leg beam middle plate (10).

The elastic force element (9) is normally a spiring or elastic strap. The spring can be manufactured such that the force necessary to stretch the spring diminishes as it is elongated. This provides the user with a leg stretch system which requires less strength to elongate the spring as the legs become fully extended. Varying the elastic force provides independent strength and range of motion exercises for physically challenged or injured users.

Figure 4:
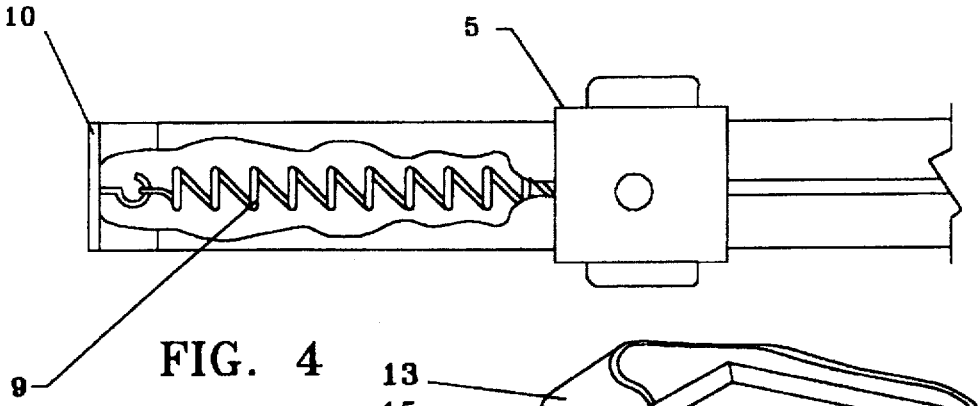
FIG. 4 illustrates a bottom cut away view of the leg beam with foot pad slide.
Figure 5:
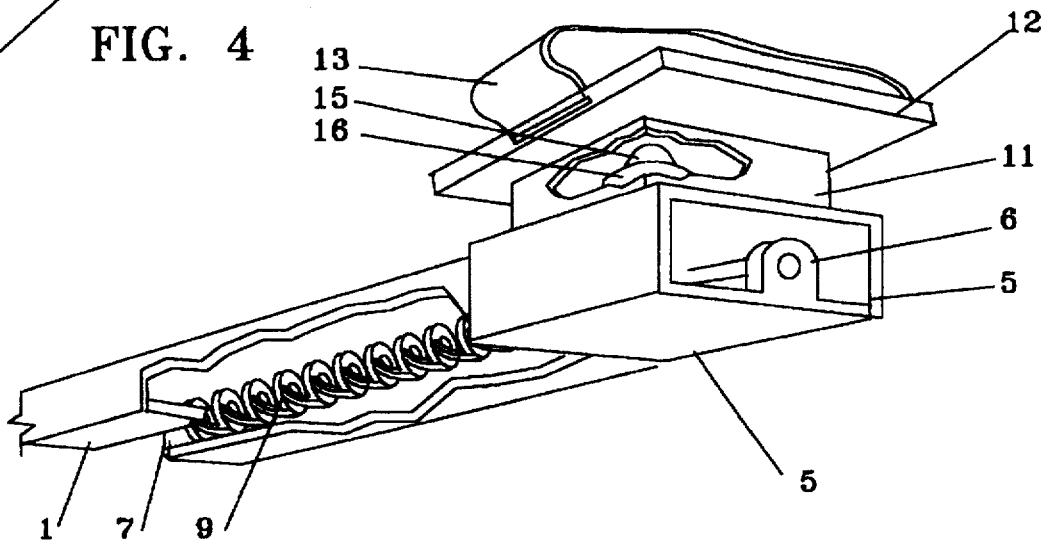
FIG. 5 illustrates a perspective view of the leg beam and foot pad slide.
Figure 6:
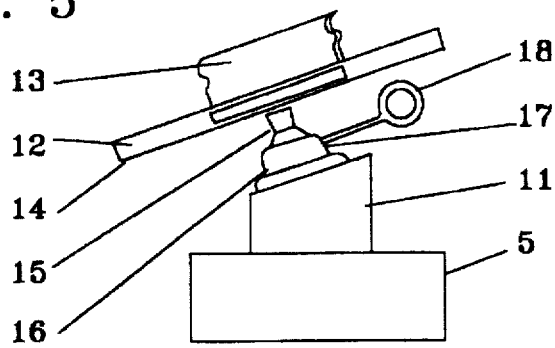
FIG. 6 illustrates a side view of the rotatable foot pad device.

Referring to FIGS. 4 through 6, the foot pad slide (5) has a foot pad pedestal (11) attached which foot pad pedestal (11) has a stirrup (12) attached. The stirrup (12) may have a foot strap (13) attached to aid in maintaining the users foot in the stirrup (12). The stirrup (12) is normally attached to the foot pad pedestal (11) by means of a rotational connector (14). The rotational connector (14) may be a simple ball (15) and socket (16) connector to allow angular rotation as the user stretches. This allows for dorsal flexion of ankles and rotation variation of approximately 90 degrees of the leg, hip, ankle and foot. The rotational connector (14) may also have a pin aperture (17) through the ball (15) and socket (16) through which a retainer pin (18) may be placed to fix the rotational connector (14) to prevent flexion to injured or physically challenged users.

Figure 3:
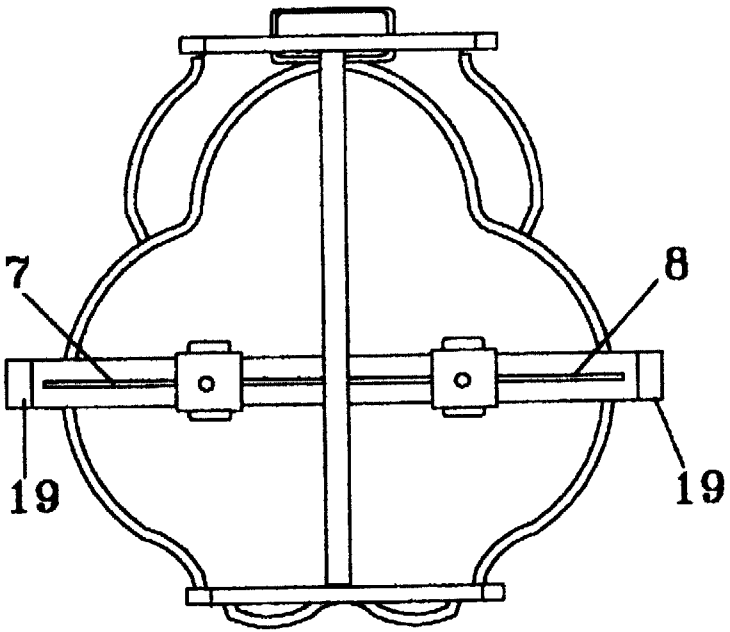
FIG. 3 illustrates a bottom view of the exercise device.
Figure 2:
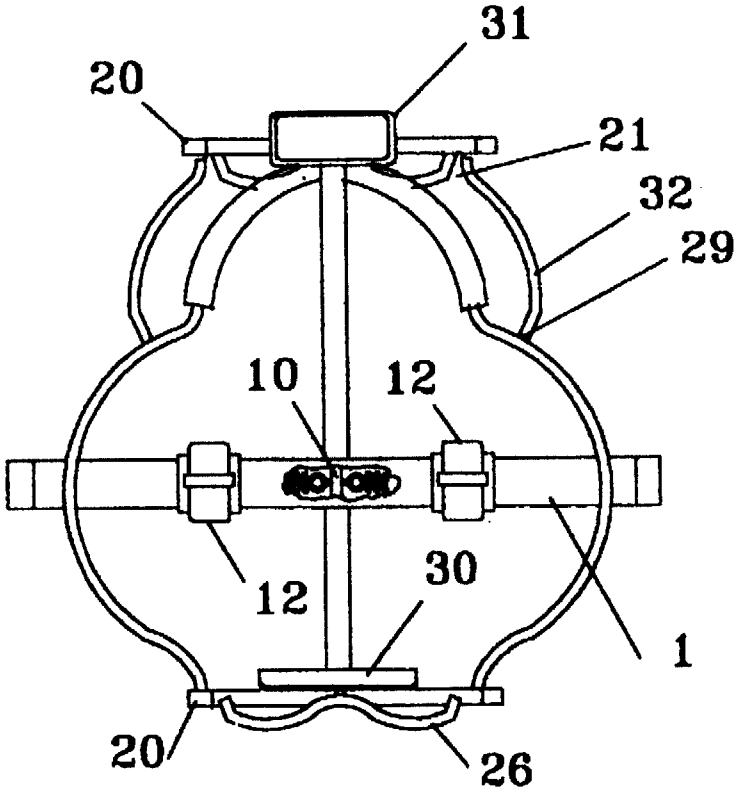
FIG. 2 illustrates a top view of the exercise device.

Referring to FIGS. 1 through 3, the leg beam (1) has support pedestals (19) attached and the back support member (3) and front support member (4) have floor sleeves (20) to provide support and inhibit movement of the exercise device on a floor. The front support member (4) has a front grip bar (21) attached which is of an irregular shaped tubular construction with two high points (22). The front grip bar (4) is also attached to a front vertical support member (23) for structural support by a front beam (24). The front grip bar (21) may have grip sleeves (25) circumferentially attached.

The back support member (3) has a back grip bar (26) attached which is of an irregular shaped tubular construction with two high points (22). The back grip bar (26) is attached at a back grip bar middle (27) by a back beam (28). The back grip bar (26) may have grip sleeves (25) circumferentially attached.

There is an exercise grip bar (29) of generally semicircular, irregular shape and of tubular construction which is attached to the back support member (3) and the front vertical support member (23). The attachment to the front vertical support member (23) is at a point to place the exercise grip bar (29) at approximately the user's shoulder height. As the exercise grip bar (29) extends toward the back support member (3) it is curved away from the vertical plane of the bottom cross member (2) and down toward the horizontal plane of the bottom cross member (2) such that the exercise grip bar (29) is approximately the height of the user's knees as it passes over the leg beam (2). From this point the exercise grip bar (29) curves down toward the horizontal plane of the bottom cross member (2) to extend and attach to the back support member (3). The exercise grip bar (29) may have grip sleeves (25) circumferential attached. A pair of cross grip bars (32) are attached between the exercise grip bar (29) and the front grip bar (21) to provide further points for the user to hold while exercising.

The back support member (3) may also have a back foot plate (30) attached. The front vertical support member (23) may have an exercise measurement device (31) attached for the user to evaluate exercise progress. The exercise measurement device (31) may be mechanical or electrically linked to the foot pad slides (5) and/or elastic force element (9) to measure the elongation or force of the movement.

Figure 7:
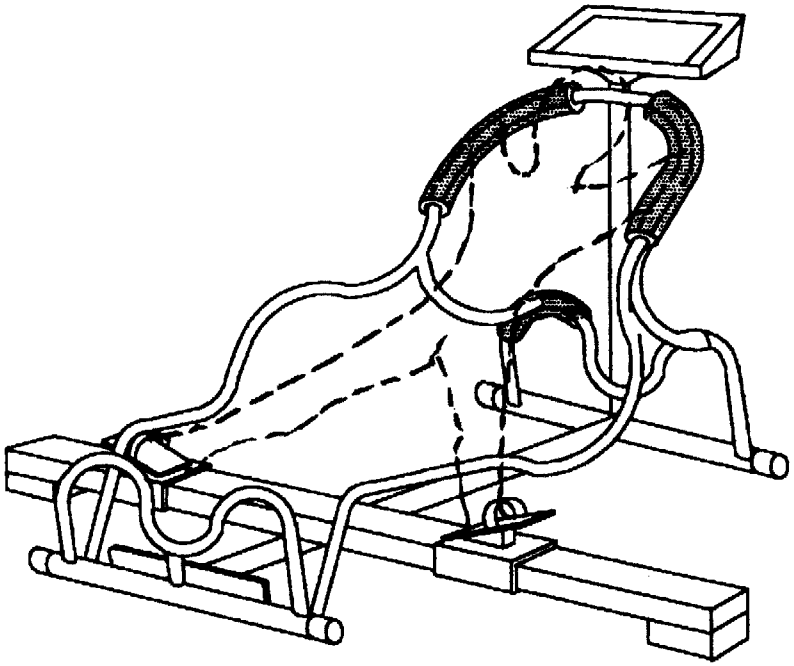
FIG. 7 illustrates a perspective view of the exercise device with the user in the fully extended, split stretch position.

Referring to FIGS. 2 and 7 through 9, a user is illustrated using the exercise device. In FIG. 2 the stirrups (12) are shown in a position perpendicular to the leg beam (1). In FIG. 7 the user has stretched his legs and rotated his feet as needed thus rotating the stirrups (12) and sliding the foot pad slides (5). In this position the user has not rotated his hips and lower back relative to the line of the stretched legs, but has stretched his upper body and shoulders to grip the exercise grip bar (29). This is commonly known as front or Chinese splits.

Figure 8:
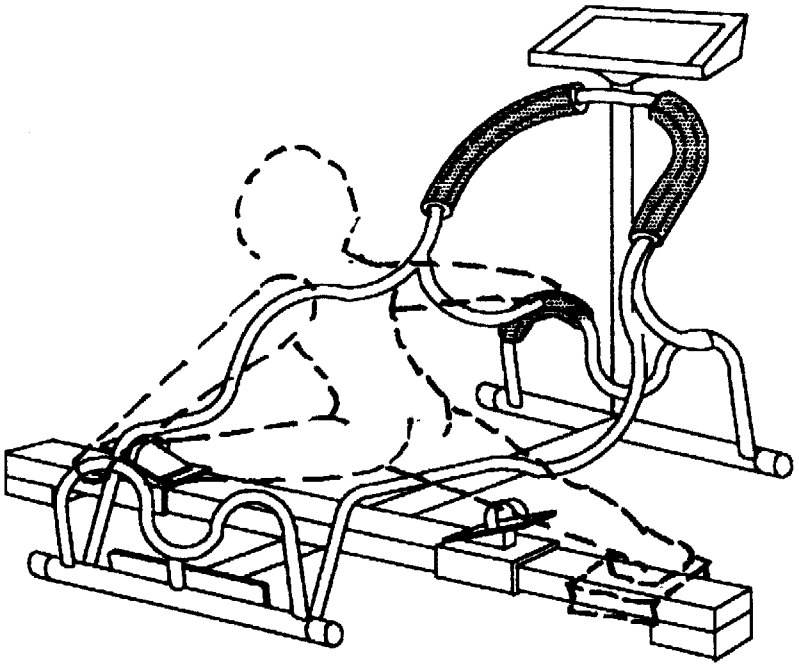
FIG. 8 illustrates a perspective view of the exercise device with the user legs fully extended and arms stretched to the side.
Figure 9:
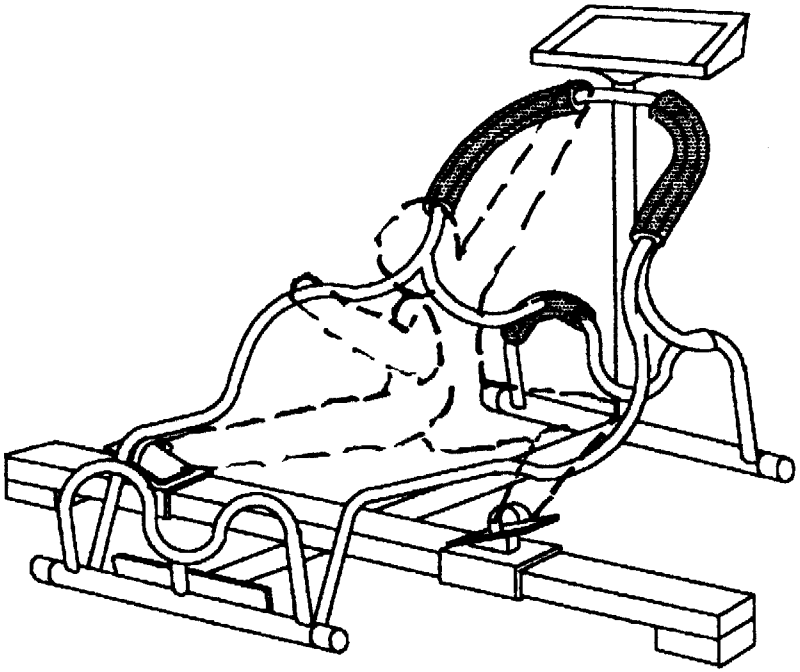
FIG. 9 illustrates a perspective view of the exercise device with the user legs extended with a bend in one knee and the arms stretched to one side of the exercise machine.

In FIG. 8 the user is also shown in the stretched leg position, but has gripped the front grip bar (21) and back grip bar (26) for stretching and for support or balance. In this example the user has rotated his feet, legs, etc. approximately 90 degrees such that the feet are in line with the leg beam (1) to do side splits. The user could also rotate the upper body and shoulders to grip the exercise grip bar (29) at a point above the leg beam (1) to stretch and provide balance as illustrated in FIG. 9. The exercise device is designed such that as the user starts from a standing position, stretches to an extended leg position and returns to stand that the exercise grip bar (29), back grip bar (26), front grip bar (21) and cross grip bar (32) may be used for balance and support and for torsion and stretch exercise of the upper body. In the FIG. 9 illustration, the user is illustrated flexing one knee as part of the exercise.

Figure 10:
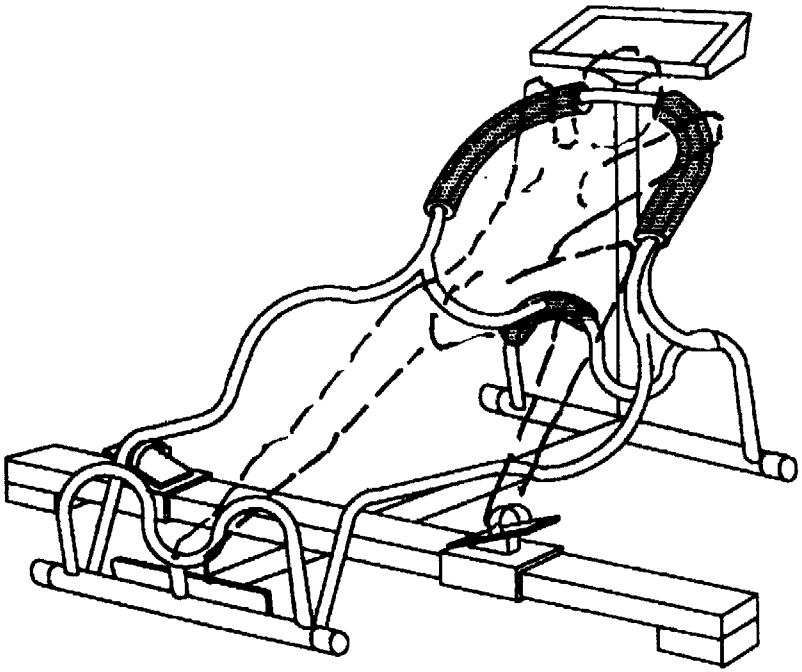
FIG. 10 illustrates a perspective view of the exercise device with the user foot place against the back foot plate in a spread exercise position.

In FIG. 10 the back foot plate (30) and exercise grip bar (29) are illustrated with the user performing achilles heel and hamstring stretch exercises with back flexure without the use of the leg beam (1).

From these illustrative representations of use it can be seen that the features of the exercise device provide strength building, flexibility and range of motion exercise. For the lower body and legs there is an adjustable resistance force to the leg stretching which provides strength building to the ligaments and tendons while also increasing flexibility. While stretching, the hip and pelvic region rotate providing range of motion and mobilization. Use of the grip bars provides stretching of the upper body and allows all ball and socket areas increased flexibility and range of motion about the torso including stretching of the arms. The entire torso may be required to exercise as the legs and arms move through the stretching maneuvers caused by the elements of the exercise device.

I claim:

1. An apparatus for human reciprocal inhibition exercise comprising:

a leg beam attached perpendicular to a bottom cross member wherein the leg beam has a pair of foot pad slides slidably mounted thereon;

the leg beam having longitudinally a leg beam right slot and a leg beam left slot defined therein and the foot pad slides each have an elastic support connector cooperatively located to slide in the leg beam right slot and the leg beam left slot;

an elastic force element attached to the elastic support connector of the foot pad slide in the leg beam left slot and a second elastic force element attached to the elastic support connector of the foot pad slide in the leg beam right slot with each elastic force element independently attached to a leg beam middle plate;

a foot pad pedestal attached to each of the foot pad slides and a stirrup attached by a means for attachment to each of the foot pad pedestals;

a back support member and a front support member attached perpendicular to the bottom cross member;

a front vertical support member attached to the front support member; and an exercise grip bar attached to the front vertical support member and attached to the back support member.

2. The apparatus as in claim 1 wherein the means for attachment to each of the foot pad pedestals is a three dimensional rotational connector.

3. The apparatus as in claim 2 wherein the rotational connector is comprised of a ball and a socket.

4. The apparatus as in claim 2 wherein the rotational connector having a pin aperture defined therein and a retainer pin for insertion in the pin aperture.

5. The apparatus as in claim 1 wherein the front support member has a front grip bar attached which front grip bar has a plurality of high points and there is a cross grip bar attached between the front grip bar and the exercise grip bar.

6. The apparatus as in claim 1 wherein the back support member has a back grip bar attached which back grip bar has a plurality of high points and is attached at a back grip bar middle to the back support member by means of a back beam.

7. The apparatus as in claim 1 wherein the back support member has a back foot plate attached.

8. The apparatus as in claim 1 wherein the exercise grip bar is attached to the front vertical support member at a height between three feet and seven feet.

* * * * *